US006056651A

United States Patent [19]

Malinoff

[11] Patent Number: 6,056,651

[45] Date of Patent: May 2, 2000

[54] GOLF BALL MOUNTING DEVICE

[76] Inventor: Don W. Malinoff, 13149 Ingres Ave., Granada Hills, Calif. 91344

[21] Appl. No.: 09/159,870

[22] Filed: Sep. 24, 1998

[51] Int. Cl.[7] ..... A63B 57/00

[52] U.S. Cl. ..... 473/400; 473/398

[58] Field of Search ..... 473/387–403, 473/386

[56] References Cited

U.S. PATENT DOCUMENTS

| | | | |
|---|---|---|---|
| 1,144,747 | 6/1915 | Abert | 473/394 |
| 1,595,797 | 8/1926 | Manson | 473/394 |
| 1,596,110 | 8/1926 | Lynch | 473/387 |
| 1,616,059 | 2/1927 | Mulvehill | 473/394 |
| 1,617,233 | 2/1927 | Byinton | 473/394 |
| 1,779,995 | 10/1930 | Trane | 473/398 |
| 1,936,625 | 11/1933 | Goldman | 473/398 |
| 3,406,977 | 10/1968 | Voelkerding | 473/398 |
| 5,033,747 | 7/1991 | Young . | |
| 5,240,254 | 8/1993 | Adlam | 473/396 |

*Primary Examiner*—Steven Wong
*Attorney, Agent, or Firm*—Colin P. Abrahams

[57] ABSTRACT

A golf ball mounting device comprises a flat elongate strip member having an upper surface, a lower surface, a mounting end and a securing end; an elevation member at the mounting end of the elongate strip member, the elevation member being dimensioned so as to receive and hold thereon a golf ball; and a fastening member at the securing end of the elongate strip for fastening the elongate strip to an anchor. The fastening member comprises an aperture having a diameter located at the securing end of the elongate strip member, a strap member extending away from the securing end, and a plug member located on the strap member. The strap member is elongate, and has a width which exceeds the diameter of the aperture. The plug member is a substantially solid cylindrical shaped member.

21 Claims, 3 Drawing Sheets

FIG. 4
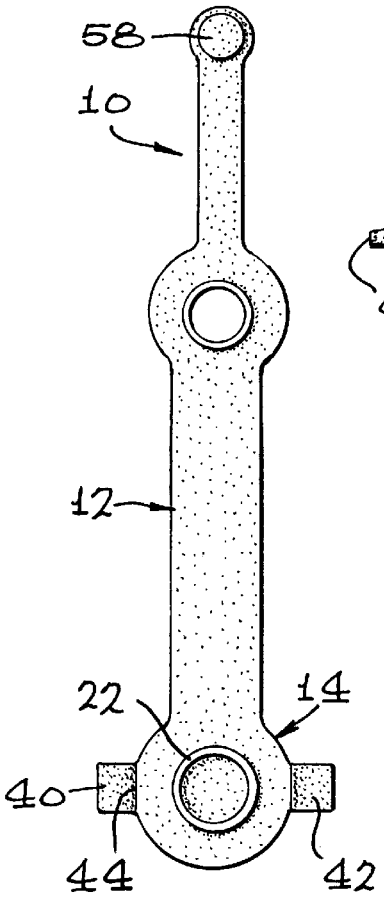
FIG. 6
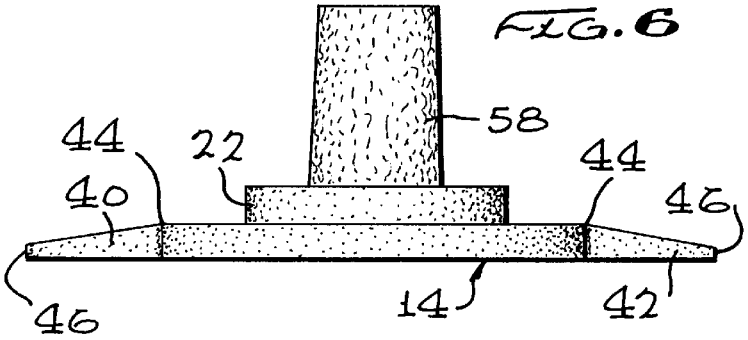
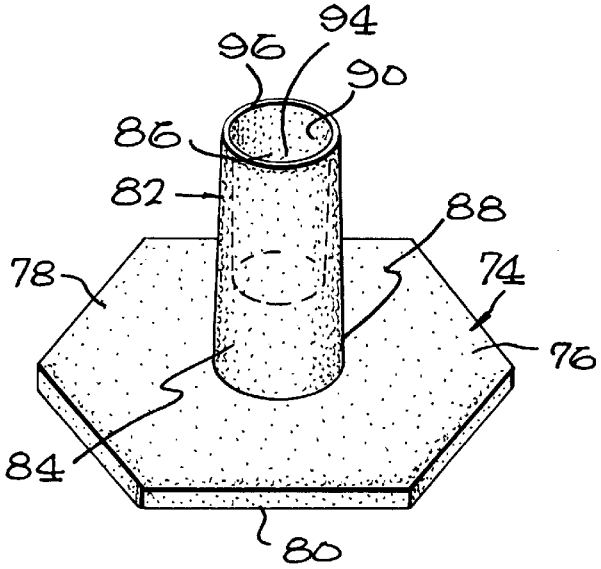
FIG. 7
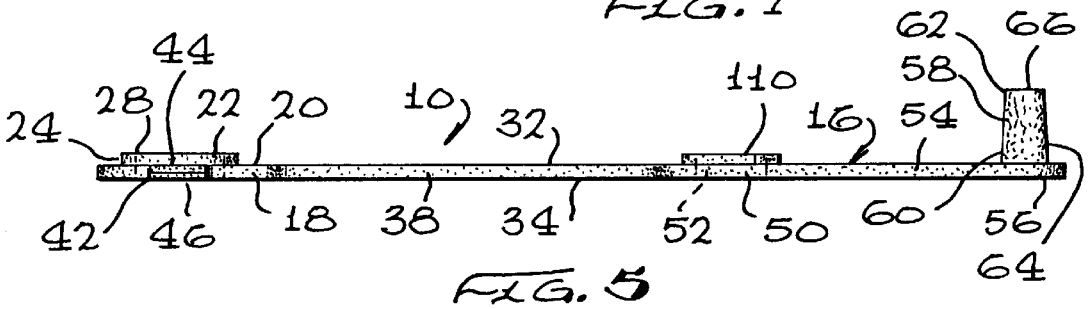
FIG. 5
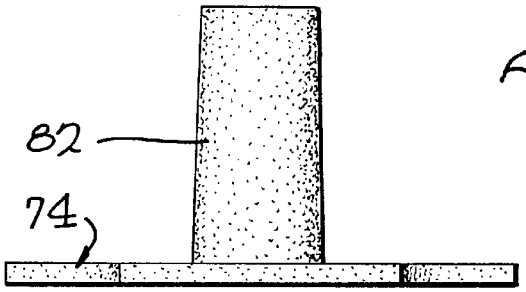
FIG. 8

GOLF BALL MOUNTING DEVICE

BACKGROUND OF THE INVENTION

This invention relates to golf ball mounting devices, and, more particularly, to a golf ball mounting device for use on artificial playing surfaces. Such artificial playing surfaces may typically be encountered by a golfer at a golf driving range where golf balls may be mounted on artificial surfaces, including synthetic turf or mats, prior to driving the ball.

The benefits of elevating a golf ball slightly above the surface on which it rests is well known, and has been used both on golf courses and driving ranges for many years. Golf tees, in innumerable shapes, sizes and formats, are known and are typically used by golfers to elevate the ball on the teeing ground, or the starting place at the beginning of play for each hole. Conventional ways of elevating the ball include a tee comprising a shaft having a point at one end and a shallow cup-shaped receptacle at the other, the point being pressed into the ground so that the cup-shaped receptacle receives the ball in such a manner that the ball is elevated off the ground by the desired height. During subsequent hits of the ball when playing a hole, the ball may not be moved and usually rests on a natural turf surface. The natural turf surface provides a slight elevation to the ball, since the ball rests on a plurality of upwardly extending blades of grass which raise the golf ball a small amount from the hard surface below. Thus, in swinging a golf club to strike a ball on a natural turf surface, the head of the golf club can be swung in an arc which may be just slightly lower than the golf ball without encountering any hard surface or being impeded by the resistance of such hard surface.

The patent literature is replete with many different shapes and forms of golf tees. As background, U.S. Pat. No. 5,033,747 (Young) is referenced as showing a golf tee assembly with reusable golf tees. Essentially, Young shows a golf tee assembly comprising a plurality of golf tees 12, 14 and 16 of varying vertical elevation, and an annular ring 20 with a central hole 22, anchoring means 26 including a tapered end portion 24 and a grasping end portion 28. To secure the golf tees of the invention of varying elevation in position for reuse, each is attached to the retaining ring by flexible attaching means, indicated by reference numeral 21, 23 and 25. To use the golf tee assembly, the retaining ring is placed over a rubberized practice tee 40 or laid directly on a teeing ground surface and the anchoring means is inserted into the ground or the practice tee, through the ring to secure the ring to the ground or make a tight fit for the practice tee. The golfer then selects the particular golf tee of desired height. In summary, the Young patent provides a reusable tee assembly with a number of individual tees so that the elevation or height of the ball can be adjusted to simulate different playing conditions.

SUMMARY OF THE INVENTION

According to one aspect of the invention, there is provided a golf ball mounting device comprising a flat elongate strip member having an upper surface, a lower surface, a mounting end and a a securing end; an elevation member at the mounting end of the elongate strip member, the elevation member being dimensioned so as to receive and hold thereon a golf ball; and a fastening member at the securing end of the elongate strip for fastening the elongate strip to an anchor.

Preferably, the mounting end comprises a circular portion having a diameter which exceeds the width of the flat elongate strip member, the elevation member comprising an elevated ring located concentrically with the circular portion. The elevated ring may have a diameter suitable for receiving and holding in a balanced form thereon and in an elevated position a golf ball.

The device may have a marking means near the mounting end of the flat elongate strip, which is preferably a pair of target elements extending outwardly from the elongate strip member at the mounting end, the target elements being of a bright, contrasting color. These target elements may be located on both sides of the mounting end for use by left and right handed golfers.

In a preferred embodiment, the fastening member comprises an aperture having a diameter located at the securing end of the elongate strip member, a strap member extending away from the securing end, and a plug member located on the strap member. Conveniently, the strap member is elongate, and has a width which exceeds the diameter of the aperture. The plug member may comprise a substantially solid cylindrical shaped member. Preferably, a circular flange is located on the upper surface of the elongate strip member and about the aperture of the fastening member.

The golf ball mounting device may further comprise an anchor, the anchor comprising a base and a shaft extending upwardly therefrom, the fastening member of the elongate strip member being secured to the shaft of the anchor. The shaft of the anchor may be at least partially hollow, and the fastening means includes a plug member received in the hollow portion of the shaft member.

According to another aspect of the invention, there is provided a golf ball mounting device comprising a flat elongate strip member having an upper surface, a lower surface, a mounting end and a securing end; an elevation member at the mounting end for receiving and balancing thereon a golf ball; a fastening member at the securing end; an anchor member including a base and a shaft extending upwardly therefrom, wherein the fastening member on the flat elongate strip member is releasably and firmly connectable to the shaft member of the anchor.

The invention is also for a method of elevating a golf ball on a synthetic or artificial surface, the method comprising: locating an elongate strip having an elevation member at one end thereof on the artificial surface; and securing the elongate strip to the artificial surface such that the elongate strip member moves naturally to a position where it is flush with the artificial surface, presenting the elevation member for balancing thereon the golf ball.

The present invention provides a novel golf ball mounting assembly, preferably for use on synthetic surfaces, and upon which a golf ball can be mounted so as to provide it with the equivalent of a natural height elevation from the surface. Preferably, the golf ball mounting device comprises a substantially flat strip having a mounting means at one end, with the other end being firmly attached to an anchor. Preferably, the golf ball mounting device is constructed such that, after hitting the ball, the device will return to its original position such that the mounting means for the ball will remain in the same place, and need not be replaced or reset.

The golf ball mounting device is particularly useful when driving golf balls from synthetic surfaces, as are often found at golf driving ranges. One of the difficulties experienced by golfers, especially those less experienced, is that there is no, or very little, elevation of the ball on synthetic surfaces, and it is therefore very important to ensure that the swing of the golf club does not result in any substantial contact between the lower edge of the golf club and the synthetic surface. Any such contact will result in resistance and vibration of the club, which is transmitted into the hands and arms of the user, and this can often cause discomfort and even pain. On natural playing surfaces, typically grass or turf, this is much less likely to occur since the turf has some thickness which has the effect of elevating the ball, and which does not offer any resistance to the path of the golf club as it moves to strike the ball.

Therefore, the golf ball mounting device of the invention is useful to golfers playing on synthetic surfaces, and is intended to compensate to a large degree for the natural elevation provided on a turf playing surface and that additional height provided by the blades of the turf which offer no resistance to the golf club. The invention facilitates a more realistic feeling to practicing on driving range mats, and helps golfers improve swing tempo. Furthermore, any mis-hits, and the stinging which may be caused thereby, are reduced, and unnecessary shocks are better absorbed. At the same time, golf head and clubs are protected.

BRIEF DESCRIPTION OF THE DRAWINGS

FIG. 4 is a top view of another embodiment of a golf ball mounting device of the invention;

FIG. 5 is a side view of the golf ball mounting device as shown in FIG. 1.

FIG. 6 is an end view of the golf ball mounting device as shown in FIG. 1;

FIG. 7 is a perspective view of the anchor of the golf ball mounting device;

FIG. 8 is a side view of the anchor shown in FIG. 6; and

DETAILED DESCRIPTION OF THE PREFERRED EMBODIMENTS

Figure 1:
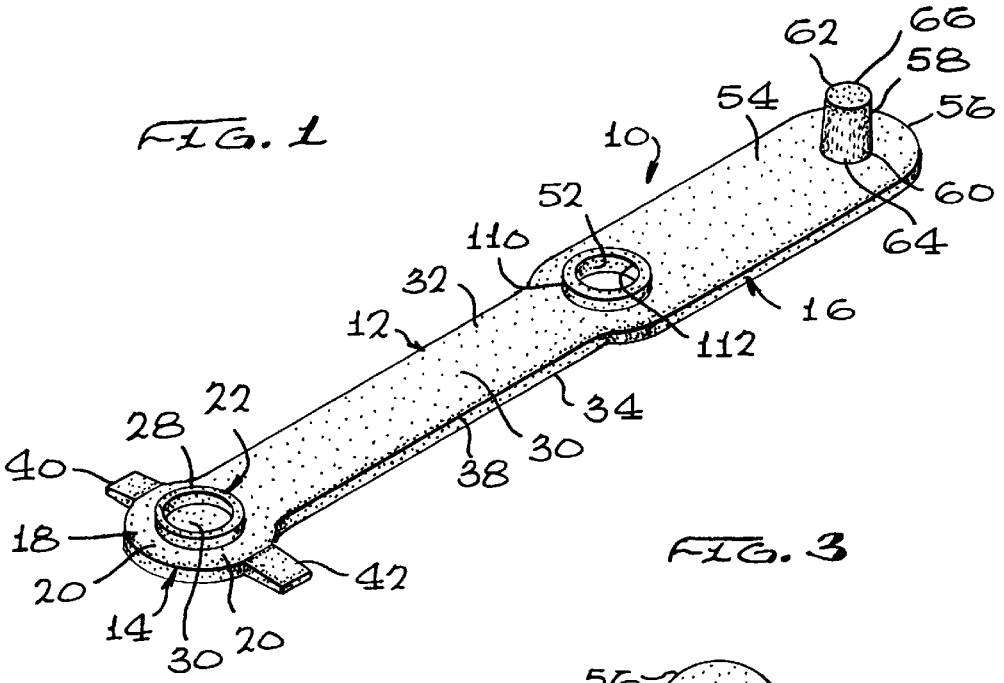
FIG. 1 is a perspective view of the golf ball mounting device of the invention.

With reference to the Figures, there is shown a golf ball tee 10 for elevating a golf ball by a predetermined height above a surface on which is to be located, and from which it will be driven by a golf club. The golf ball tee 10 comprises an elongate strip 12 having a tee-end 14 and a fixing end 16. The tee-end 14 consists of a circular mat 18 which is integral with the elongate strip 12. The circular mat 18 has located on its upper surface 20 a raised ring 22 and extends upwardly from the upper surface 20 of the circular mat 18. The raised ring 22 comprises an outer wall 24 and inner wall 26, and a top wall 28 upon which the golf ball is, in practice, received. The raised ring 22 defines a base portion 30 which, in effect, forms a part of the circular mat 18. The base portion 30 may be either flat, or slightly concave, as best illustrated in FIG. 4, depending upon the height of the raised ring 22. The flatness or curvature of the base portion 30 is designed so that the outside curvature of a golf ball will be received and held on the top wall 28 of the raised ring 22, and may also rest on the base portion 30, or, at least, a part thereof.

The elongate strip 12 has an upper surface 32 and a lower surface 34. Both the upper and lower surfaces 32 and 34 are essentially flat and parallel to each other, with the lower surface 34 being designed to rest flush a upon the artificial or other surface from which the golf ball is being driven. The elongate strip further comprises side walls 36 and 38 which are of relatively small dimension, as compared to the upper and lower surfaces 32 and 34. In other words, the width of the elongate strip 12, as represented by the upper and lower surfaces 32 and 34, is considerably greater than the height thereof, as represented by the side walls 36 and 38.

A pair of target elements 40 and 42 are located on the tee-end of the elongate strip. The target elements 40 and 42 are substantially radially opposed to each other, and extend outwardly from the circular mat so that the axes of the target elements 40 and 42 are substantially at right angles to the axis of the elongate strip 12. Each target element 40 and 42 is of a wedge shape, having a height or thickness at a point 44 which is equivalent to the height or thickness of the side walls 36 or 38, scaling down to a thin end 46.

The fixing end 16 of the elongate strip comprises a circular portion 50 which defines a circular hole 52. As will be described below, the circular hole 52 accommodates a shaft of an anchor for fixing the golf ball tee 10 in place. The fixing end 16 further comprises a strap member 54 terminating at the strap end 56. At the strap end 56, there is located a cylindrical plug 58 which preferably tapers slightly, having a slightly larger diameter at its base 60, and a slightly smaller diameter at the plug end 62.

Figure 3:
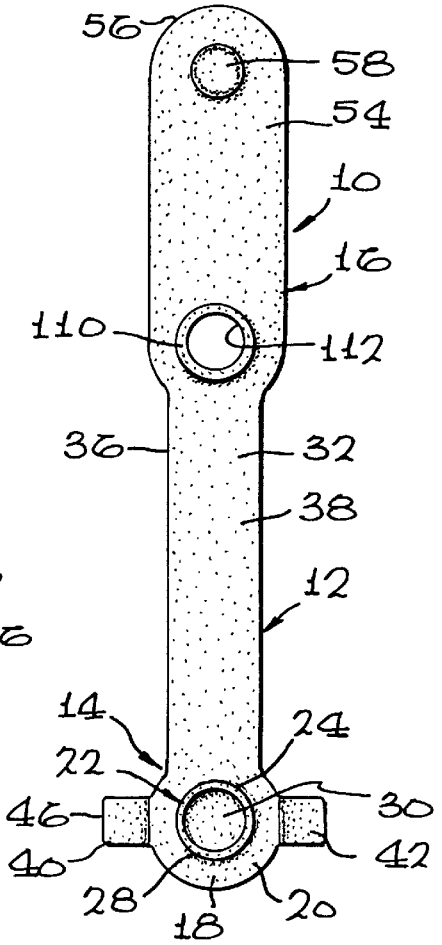
FIG. 3 is a top view of the golf ball mounting device of the invention as shown in FIG. 1.

In a preferred embodiment, as is shown in FIG. 3, it will be seen that the width of the strap member 54 is greater than the diameter of the circular hole 52. This becomes an important feature since it helps to prevent, as will be discussed below, the golf ball tee from moving such that the circular hole slides up and over the strap member 54 upon the impact of the golf club. As long as the strap member 54 is of greater width than the diameter of the circular hole 52, such movement will be prevented, and facilitates the return of the golf ball tee 10 to its desired position after each golf ball, mounted on the raised ring 22, has been driven or struck by a golf club. FIG. 4 shows an embodiment with a narrower strap member 54, and, for convenience in understanding, the same reference numerals have been used in both of FIGS. 3 and 4.

In a preferred embodiment of the invention, the golf ball tee 10 is molded with thermoplastic rubber material, and has a considerable capacity to withstand repetitive and substantial strikes by a golf club, without breaking or tearing. Preferably, the entire golf ball tee 10 is green in color such that it blends with the surface, usually an artificial turf, on which it is mounted, and thus offers a minimal distraction to the golfer. While almost the entire golf ball tee is one of a number of shades of green, the target elements 40 and 42 are preferably coated or molded with a bold contrasting color, such as red, to catch the eye of the golfer. It has been found that these target elements 40 and 42 facilitate focusing of the attention of the golfer on the relevant spot, since the golfer should aim for the target elements 40 or 42 in attempting to hit the ball from the most advantageous angle and location. Therefore, it is desirable that these target elements 40 and 42 have a contrasting color to help focus the golfer's attention on that point through which the golf club should move.

As has been described above, each of the target elements 40 and 42 is a wedge shape, with the thin end 46 being at a point remote from the circular mat 18. The effect of this wedge shape, and the thin end 46 at the end of each target element 40 and 42, helps to ensure that the target elements do not as easily block the path of the golf club swing, and are less likely to offer a surface which can be struck. This is an important feature, since, the premature striking of the golf ball tee 10, where the golf club connects to either one of the target elements 40 and 42, would move the golf ball tee 10, and the golf ball mounted on the raised ring 22. Although this would happen only a split second before the ball itself is hit, the effect may be severe enough to affect the point at which the club contacts the golf ball, and thus impair the trajectory and direction of the golf ball.

In a preferred embodiment, the cylindrical plug 58 has a very slight taper, which may be as little as a half degree to one degree. Furthermore, the cylindrical plug 58, which consists of a circular side wall 64 and an end wall 66, preferably has a textured or slightly roughened surface which enhances the connection of the cylindrical plug 58 within the anchor as will be described below. This textured surface effect helps to increase the frictional engagement between the circular side walls 64 of the cylindrical plug 58, and the inner wall of the shaft to ensure that the substantial forces to which the golf ball tee is subjected during the drive of the golf ball does not result in the ejection of the cylindrical plug 58, thus undermining the connection and stability of the golf ball tee 10.

Figure 2:
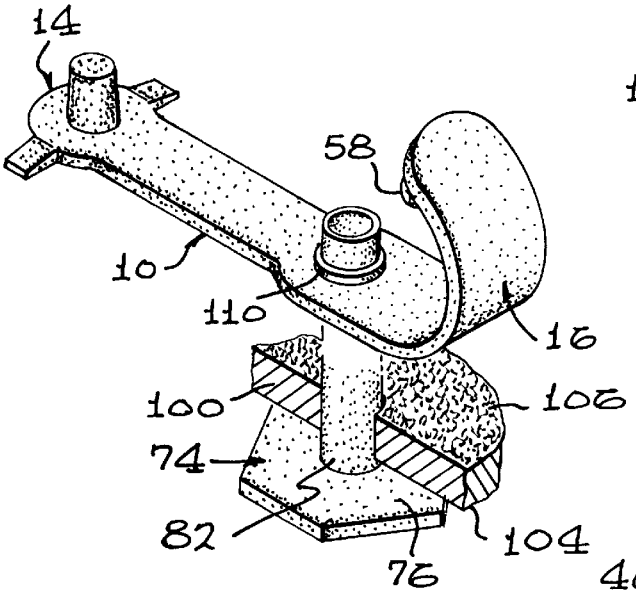
FIG. 2 is an exploded perspective view of the golf ball mounting device as shown in FIG. 1, shown in its position when fixed to an anchor in an artificial surface.
Figure 9:
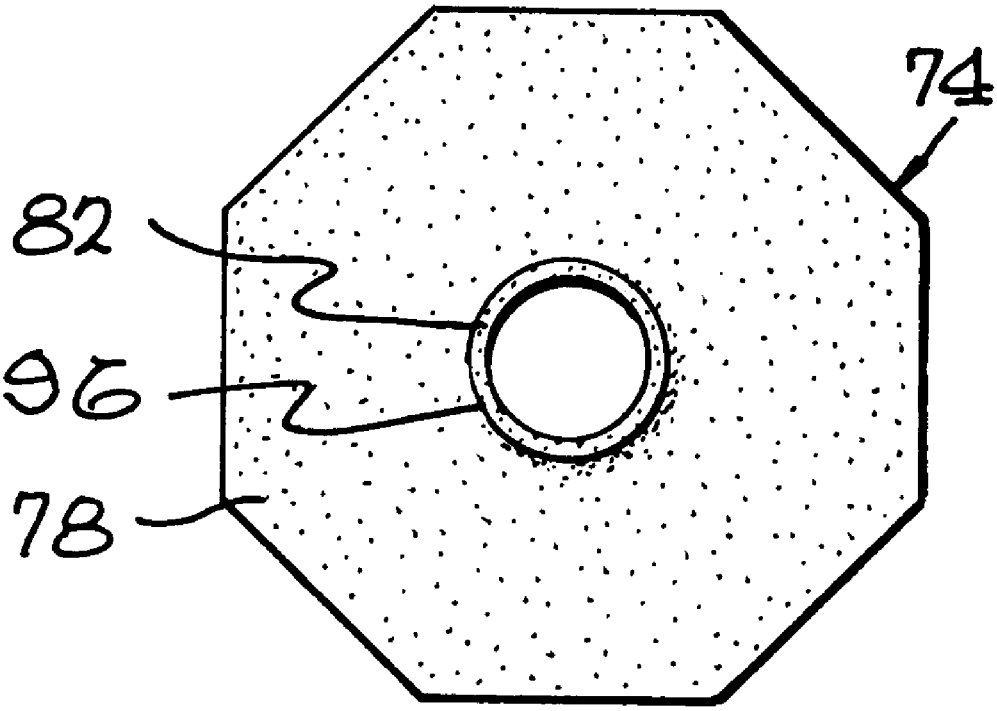
FIG. 9 is a top view of a second embodiment of the anchor, having an octagonal base.

Reference is now made to FIGS. 2 and 6 of the drawings, which shows an anchor 74 for securing a golf ball tee 10 to a surface. The anchor 74 comprises a base member 76 having an upper surface 78 and a lower surface 80, the base member 76 preferably being a relatively flat hexagon or octagon shaped member. Centrally located on the upper surface 78 of the base member 76, and extending upwardly therefrom, is a shaft 82, the shaft 82 having a solid section 84 and a hollow section 86. The shaft 82 is substantially of cylindrical shape and is preferably comprised of a durable resilient plastics material, such as thermoplastic rubber. The shaft 82 includes an upper outer wall 88, and the hollow section 86 of the shaft 82 has an inner wall 90 and a base wall 92. The hollow section 86 defines a plug space 94 which is designed to receive and firmly hold the cylindrical plug 58 which forms part of the fixing end 16 of the golf ball tee 10. Preferably, the inner wall 90 of the hollow section 86 is textured or has a slightly roughened finish, to increase the frictional forces between the inner wall 90 and the circular side wall 64 of the cylindrical plug 58. The effect of these textured surfaces is to facilitate tension of the cylindrical plug 58 within the plug space 94, even under considerable forces that are normally experienced by the effect of the golf club as it may hit the golf ball tee 10. In one embodiment, the inner wall 90 of the hollow section 86 may be tapered, with the rim 96 of the shaft 82 being just slightly wider than the inside diameter of the plug space 94 near the base wall 92. The slight tapering of either or both of the cylindrical plug 58 and the hollow section 86 of the shaft 82 serves to enhance the secure connection of the cylindrical plug 58, when located within the plug space 94.

In use, the golf ball tee 10 and anchor 74 are used in conjunction with the each other, with both secured to a synthetic or artificial turf surface 100 on a golf course, golf driving range or other appropriate location.

In FIG. 2, the applied position of the golf ball tee 10 and anchor 74 are shown. In this Figure, there is shown an artificial surface such as synthetic turf 100 including an aperture 102 therein, the aperture 102 being of conventional size, which is approximately the same as or slightly larger than the diameter of the shaft 82. The synthetic turf 100 is raised or turned over, as appropriate, and the anchor 74 is located in the aperture 102 such that the shaft 82 extends through and beyond it, while the base member 76 remains under the lower surface 104 of the synthetic turf 100. The rim 96 of the shaft 82 extends a short distance beyond the upper surface 106 of the synthetic turf 100. The synthetic turf 100 is then replaced on the surface on which it rests so as to be in a flat position, whereby the anchor 74 is firmly located in the aperture 102 so that it is solidly secured in position and will not move. Thereafter, the golf ball tee 10 is located with respect to the anchor 74, such that the circular hole 52 at the fixing end 16 of the golf ball tee 10 circumscribes or surrounds the shaft 82. In other words, the shaft 82 is received within, and fully fills, the circular hole 52. The golf ball tee 10 is then pushed down such that the circular portion 50 is substantially flat on the upper surface 106 of the synthetic turf 100. In this position, the strap member 54 is bent or folded over and the cylindrical plug 58 forcibly inserted into the plug space 94. The fit of the cylindrical plug 58 within the plug space 94 is an extremely tight one since a firm connection between the golf ball tee 10 and the anchor 74 is essential for the proper functioning of the golf ball tee 10. As has already been mentioned above, either one or both of the circular side walls 64 and/or the inner wall 90 has a textured or roughened surface to enhance and secure the connection between the cylindrical plug 58 and the shaft 82. Moreover, the tapering of the circular side wall, and/or the plug space 94 also serves to ensure a tight and secure fit of the plug 58 within the space 94.

The golf ball tee 10, properly mounted on the secured anchor 74, is now ready for use and a golf ball is located so as to rest on the raised ring 22. The height of the circular mat 18, coupled with the height of the raised ring 22, elevates the golf ball to the desired position so as to provide a "give" or non-resistant space between the lowermost portion of the golf ball and the hardened surface of the synthetic turf. This emulates that space which is defined when a golf ball rests on natural turf, since it be is to some extent elevated by the grass blades, and there is a short or small space between the lowermost portion of the ball, and the ground, which will offer no or little resistance to the swing of a golf club, and will not block or otherwise cause discomfort to the golfer.

It will be appreciated that, while the thickness of the circular mat 18 will not vary much, the elevation of the golf ball can to a large extent be adjusted or varied by changing the height of the raised ring 22. Thus, according to the preference of the golfer, or the conditions which are being emulated (such as putting green, fairway, rough, ground or sand bank), golf tees having raised rings of different heights can be used.

One important preferable feature of the golf ball tee is its ability to return to substantially the same position it occupied even after it may have been violently struck by a swinging club. The strap-like quality of the elongate strip 12 with the significant width and fairly small height, tends to ensure that, when the elongate strip is moved and folds over in any way, its shape and resilience will cause an unfolding so as to return it to the original position. This is achieved by the shape of the elongate strip 12, coupled with the firm connection thereof at the fixing end 16 with the anchor 74. Further, in a preferred embodiment of the invention, the strap member 54 is constructed so that its width is greater than the diameter of the circular hole 52. In certain instances, where the width of the strap 54 is the same as, or less than, the diameter of the circular hole 52, any substantial force causing movement of the golf ball tee 10 may result in the circular portion 50 traveling up the shaft 82, and beyond onto the strap member 54. However, this may easily be avoided, as mentioned above, by ensuring an adequate width of the strap member 54.

It will be noted that the rim 96 at the top of the shaft 82 may have a bevelled edge such that the uppermost point of the rim is wider, and narrows inwardly by the width of the wall of the hollow section. In this way, the aperture presented for insertion of the plug 58 is of slightly greater diameter than the plug 58, and has the effect of centering the plug as it is pushed towards the base wall 92 of the plug space 94. This makes it easier for the user to insert the plug.

Another aspect of the plug/plug space connection is that the insertion of the cylindrical plug 58 within the plug space 94 actually has the effect of ensuring that the circular portion 50 remains near the lower end of the shaft 82, and stays almost flush with the upper surface 106 of the synthetic turf 100. In this regard, it is to be noted that the insertion of the cylindrical plug 58 within the plug space 94, especially when the cylindrical plug 58 is of substantially the same diameter of just slightly greater diameter than the plug space 94, has the effect of slightly expanding the outer wall 88 where the plug 58 is inserted. With the outer wall 88 somewhat expanded, the circular portion 50 is more forcefully engaged with the shaft, and is prevented from moving up the length of the shaft in this condition.

To further enhance the connection between the circular portion 50 and the shaft 82, there is located a circular flange 110 around the circular hole 52. The flange 110 thus provides the circular portion 50 with a circular hole 52 having a side wall 112 which is of greater dimension or height, thus enhancing the connection and ensuring that the golf ball tee 10 remains in a reasonably fixed position with respect to the anchor 74, even though both the tee 10 and the anchor 74 are subject to such excessive forces.

Although the particular embodiments described hereabove, whereby the golf ball tee 10 is fixed to the anchor 74, have been found to work effectively in maintaining the connection under adverse conditions, it is within the scope of the invention to provide any other means for connecting the golf ball tee 10 to the anchor 74. For example, the tee 10 can be connected to the anchor 74 by a appropriately pinning it through transverse slots or apertures which may be provided. Furthermore, where a plug is used, as in the embodiment. described above, the plug and corresponding plug space may be of square, hexagonal, octagonal or other suitable shape to further enhance the fit and connective capacity between the plug and the plug space in the shaft. The taper in the plug space, and of the plug itself, may be enhanced and amplified to strengthen the fit.

In a further embodiment, the connection of the golf ball tee 10 to the shaft 74 may comprise a cylindrical member mounted on the upper surface 32 of the circular portion 50 extending upwardly approximately the height of the shaft 82. Within the cylinder, there may be located a smaller diameter cylindrical portion which defines between the outer cylinder and the inner cylinder an annular space which receives the wall of the hollow section 86.

EXAMPLE

In an example of a preferred embodiment, the golf ball tee and anchor have the following dimensions:

| | |
|---|---|
| Total length of golf tee | 9.5 inches |
| Width of elongate strip | 1 inch |
| Width of strap member | 1.5 inches |
| Thickness or height of golf ball tee | 0.8 inch |
| Diameter of circular mat | 1⅝ inches |
| Diameter of raised rim | 1 inch |
| Height of raised rim | 0.8 inch |

-continued

| | |
|---|---|
| Length of target elements | 0.75 inch |
| Diameter of circular portion | 1.5 inch |
| Diameter of circular hole | ⅝ inch |
| Length of cylindrical plug | 0.75 inch |
| Diameter of cylindrical plug | approximately 0.5 inch |
| Height of shaft | 1⅞ inches |
| Angle of target element | 12°–13° |

I claim:

1. A golf ball mounting device comprising:

a flat elongated strip member having an upper surface, a lower surface, a mounting end and a securing end;

an elevation member at the mounting end of the elongate strip member, the elevation member being dimensioned so as to receive and hold thereon a gold ball;

a fastening member at the securing end of the elongate strip member for fastening the elongate strip to an anchor; and an anchor comprising a base and a shaft extending upwardly therefrom, the fastening member of the elongate strip member being secured to the shaft of the anchor, wherein the shaft of the anchor is at least partially hollow, and the fastening means includes a plug member received in the hollow portion of the shaft member.

2. A golf ball mounting device as claimed in claim 1 wherein the mounting end comprises a circular portion having a diameter which exceeds the width of the flat elongate strip member, the elevation member comprising an elevated ring located concentrically with the circular portion.

3. A golf ball mounting device as claimed in claim 2 wherein the elevated ring has a diameter suitable for receiving and holding in a balanced form thereon and in an elevated position a golf ball.

4. A golf ball mounting device as claimed in claim 1 further comprising a marking means near the mounting end of the flat elongate strip.

5. A golf ball mounting device as claimed in claim 4 wherein the marking means comprises a pair of target elements extending outwardly from the elongate strip member at the mounting end, the target elements being of a bright, contrasting color.

6. A golf ball mounting device as claimed in claim 5 wherein each target element comprises a wedge shaped member having a thick end adjacent the elongate strip member, and a thin end remote therefrom.

7. A golf ball mounting device as claimed in claim 1 comprised of a thermoplastics material.

8. A golf ball mounting device as claimed in claim 1 wherein the fastening member comprises an aperture having a diameter located at the securing end of the elongate strip member, a strap member extending away from the securing end, and a plug member located on the strap member.

9. A golf ball mounting device as claimed in claim 8 wherein the strap member is elongate, and has a width which exceeds the diameter of the aperture.

10. A golf ball mounting device as claimed in claim 8 wherein the plug member comprises a substantially solid cylindrical shaped member.

11. A golf ball mounting device as claimed in claim 8 further comprising a circular flange located on the upper surface of the elongate strip member and about the aperture of the fastening member.

12. A golf ball mounting device as claimed in claim 1 further comprising an anchor, the anchor comprising a base and a shaft extending upwardly therefrom, the fastening member of the elongate strip member being secured to the shaft of the anchor.

13. A golf ball mounting device as claimed in claim 1 wherein:

the fastening member comprises an aperture at the securing end of the flat elongate strip member, a strap member extending from the securing end, and a plug member located on the strap member; and an anchor member is provided, the anchor member having a base, and a shaft extending upwardly therefrom, the shaft having a partially open ended hollowed out portion, the hollow portion being dimensioned so as to releasably but securely receive the plug member of the fastening member.

14. A golf ball mounting device comprising:

a flat elongate strip member having an upper surface, a lower surface, a mounting end and a securing end;

an elevation member at the mounting end for receiving and balancing thereon a golf ball;

a fastening member at the securing end;

an anchor member including a base and a shaft member extending upwardly therefrom, the shaft member having an upper rim which is bevelled to facilitate insertion of a plug within the hollow portion of the shaft member, wherein the fastening member on the flat elongate strip member is releasably and firmly connectable to the shaft member of the anchor.

15. A golf ball mounting device as claimed in claim 14 further comprising a target element extending outwardly from the elongate strip member at the mounting end, the target elements being of a bright, contrasting color and comprising a wedge shaped member having a thick end adjacent the elongate strip member, and a thin end remote therefrom.

16. A golf ball mounting device as claimed in claim 14 wherein the fastening member comprises an aperture at the securing end of the flat elongate strip member, a strap member extending from the securing end, and a plug member located on the strap member.

17. A golf ball mounting device as claimed in claim 16 wherein the width of the strap member is greater than the diameter of the aperture.

18. A golf ball mounting device as claimed in claim 16 further comprising a circular flange about the aperture member.

19. A golf ball mounting device as claimed in claim 14 wherein the mounting end comprises a circular mat, and the elevation member comprises a raised ring mounted on the circular mat, the raised ring being substantially concentric with the circular mat.

20. A golf ball mounting device as claimed in claim 14, the device being mountable on a synthetic surface, the color of the mounting device being selected so as to blend with that of the synthetic surface.

21. A golf ball mounting device as claimed in claim 20 further comprising a marking element at the mounting end of the flat elongate strip member, the marking element having a color selected to contrast with that of the elongate strip member.

* * * * *